United States Patent [19]

Taniguchi et al.

[11] Patent Number: 4,502,068

[45] Date of Patent: Feb. 26, 1985

[54] THERMOSENSITIVE RECORDING MATERIAL

[75] Inventors: Keishi Taniguchi, Shizuoka; Kiyotaka Iiyama, Mishima, both of Japan

[73] Assignee: Ricoh Company, Ltd., Tokyo, Japan

[21] Appl. No.: 527,899

[22] Filed: Aug. 30, 1983

[30] Foreign Application Priority Data

| | | | |
|---|---|---|---|
| Sep. 20, 1982 | [JP] | Japan | 57-163650 |
| Oct. 12, 1982 | [JP] | Japan | 57-178882 |
| Oct. 20, 1982 | [JP] | Japan | 57-184141 |
| Nov. 1, 1982 | [JP] | Japan | 57-192036 |

[51] Int. Cl.[3] ..... B41M 5/18; B41M 5/22

[52] U.S. Cl. ..... 346/216; 346/217; 346/221; 346/225; 346/226; 427/150; 427/151

[58] Field of Search ..... 282/27.5; 427/150–153; 428/320.4–320.8, 411, 488, 537, 913, 914, 411.1, 488.1, 488.4, 537.5; 346/216, 217, 221, 225, 226; 524/331; 568/47, 52, 54

[56] References Cited

U.S. PATENT DOCUMENTS 4,420,538 12/1983 Nakamura et al. ..... 282/27.5

*Primary Examiner*—Bruce H. Hess

*Attorney, Agent, or Firm*—Flynn, Thiel, Boutell & Tanis

[57] ABSTRACT

A thermosensitive recording material is disclosed, which comprises a colorless or light-colored coloring material, and a color developer capable of inducing color formation in the colorless or light-colored coloring material upon application of heat thereto, in which the color developer is a phenolic material of the formula

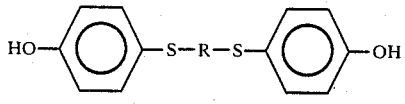

wherein R is an alkylene group selected from the group consisting of an alkylene group having 1 to 10 carbon atoms; an alkylene group having 1 to 8 carbon atoms which are not directly bonded to S in the formula, with 1 to 3 carboxylic groups contained therein; and an alkylene group having 2 to 15 carbon atoms, with 1 to 5 ether bonds contained therein.

6 Claims, No Drawings

THERMOSENSITIVE RECORDING MATERIAL

BACKGROUND OF THE INVENTION

The present invention relates to a thermosensitive recording material, and more particularly to a thermosensitive recording material capable of forming images with high density at high speed recording.

In general, a conventional thermosensitive recording material comprises a support material made of, for example, paper or a film, and a thermosensitive coloring layer formed on the support material, which thermosensitive coloring layer comprises as the main components, a colorless or light colored dye such as leuco dye, and a color developer such as a phenolic material which is capable of inducing color formation in the colorless or light colored dye upon application of heat thereto, for example, through a thermal head of a thermal printer. This thermal recording is attained by a chemical reaction between the colorless or light colored dye and the color developer upon application of heat thereto. As compared with other conventional recording materials, the above described type thermosensitive recording materials have advantages in that recording can be performed without requiring complicated steps such as development and image fixing; therefore, such recording is done speedly, quietly and at a low cost. Because of these advantages, the thermosensitive recording materials are widely used, for instance, for use with computers, facsimile apparatus, telex, medical measurement instruments and other measuring instruments in a variety of fields.

In accordance with the recent general demand for high speed recording, there is a great demand for a thermosensitive recording material that is suitable for use in high speed recording, in particular, for use with the above-mentioned fields.

Conventionally, thermosensitive recording materials for use in high-speed recording have been proposed, for instance, in Japanese Laid-Open Patent Application No. 53-39139, Japanese Laid-Open Patent Application No. 53-26139, Japanese Laid-Open Patent Application No. 53-5636, and Japanese Laid-Open Patent Application No. 53-11036. In those thermosensitive recording materials, thermo-fusible materials with a low melting point, such as a variety of waxes, fatty acid amides, alkylated biphenyls, substituted biphenyl alkanes, coumarinic acid derivatives, biphenyl amines, are added to the thermosensitive coloring layer as a sensitizer or as an agent for reducing the melting point of the thermosensitive coloring layer.

In the case where the above described sensitizer agents are employed, it is necessary that the sensitizer agent be melted prior to the coloring reaction. Therefore, in the high-speed recording by application of a small amount of heat energy in an extremely short time, for instance, by heat-application impulses, a sufficiently high thermal response for practical use cannot be obtained. In addition to the above problem, in the above case, since the thermo-fusible materials are melted within the thermosensitive coloring layer, the accumulation of the melted thermo-fusible materials on a thermal head during an image recording process, trailing of the printed images and formation of ghost images are apt to occur. Furthermore, fogging is apt to occur in the background of thermosensitive recording material during storage at high temperatures and high humidities.

As a result, the contrast of the recorded images decreases during storage.

Therefore, it is more preferable not to use the above described sensitizer agents or melting-point reducing agents in the thermosensitive recording materials for use in high speed recording.

Conventional colorless or light-colored dyes which are colored upon application of heat thereto for use in the thermosensitive recording materials, for example, dyes having lactone rings, lactam rings or spiro-pyran rings, usually have the melting points in the range of 160° C. to 240° C. Due to such high melting points of the colorless or light colored dyes, when the above described sensitizer dyes or melting points reducing agents are not employed, phenolic materials with particularly low melting points are used in combination as a color developer for inducing color formation in the above-mentioned colorless or light-colored dyes, in order to obtain thermal recording materials with high thermal sensitivities suitable for use in high-speed recording.

Phenolic color developers are described in many references including Japanese Patent Publication No. 45-14039. Among a large number of phenolic color developers, 2,2-bis(4'-hydroxyphenyl)propane (or Bisphenol A, m.p. 156°–158° C.) is preferably used, because of the stability of the quality as the color developer, and the reasonable price and availability. Bisphenol A, however, has the shortcoming that its color inducement temperature is relatively high.

In contrast to this, in the case where phenolic materials with low melting points, for instance, monohydric phenols, such as 4-t-butylphenol (m.p. 94°–99° C.), α-naphthol (m.p. 95°–96° C.), and β-naphthol (m.p. 119°–122° C.) are employed, the preservability and stability of the thermal recording materials are so poor that the background thereof is discolored with time at room temperature during storage. Further, thermal recording materials containing such monophenols therein have a characteristics phenolic odor and are not suitable for practical use.

In Japanese Patent Publication No. 54-12819 and Japanese Patent Laid-Open Application No. 55-27253, 2,2-bis(4'-hydroxyl phenyl)-n-hexane (m.p. 99°–103° C.) and 1,1-bis(4'-hydroxyl phenyl)alkane (the alkane having 3 to 13 carbon atoms) are respectively disclosed as having low melting points and being capable of yielding images in a stable manner when they are employed in thermosensitive recording materials. However, these materials are difficult to synthesize and cannot be obtained easily.

In Japanese Laid-Open Publication No. 56-144193, it is described that a lower alkyl ester and a benzyl ester of p-hydroxybenzoic acid can be easily synthesized, and, by use of the esters, thermosensitive recording materials with high sensitivity can be prepared. However, the thermosensitive recording materials using the esters have the shortcomings that the colored portions easily discolor and the phenolic materials are separated in the developed image areas in the form of white crystals or powders.

As described above, there are known no thermosensitive recording materials which yield images with high density, high sharpness and high stability in high-speed recording, using a color developer that can be employed for industrial and practical use.

SUMMARY OF THE INVENTION

It is therefore an object of the present invention to provide an improved thermosensitive recording material which is capable of yielding images with high density and high sharpness in a stable manner in high-speed recording, by use of a color developer that can be employed for industrial and practical use.

The object of the present invention can be attained by using a phenolic material of the following formula as a color developer in the thermosensitive recording material which employs a coloring reaction between a colorless or light-colored leuco dye and a color developer:

(I)

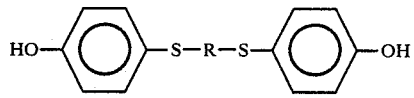

wherein R represents an alkylene group having 1 to 10 carbon atoms; an alkylene group having 1 to 8 carbon atoms, with 1 to 3 carbonyl groups contained within the alkylene group, without being bonded to S in the formula; or an alkylene group having 2 to 15 carbon atoms, with 1 to 5 ether bonds contained within the alkylene group.

Among the color developers covered by the above formula, the color developers with R being the alkylene group having 1 to 5 ether bonds induce color formation in a fluoran compound of the following formula (II), with particularly excellent image quality and high resistance to plasticizers contained, for example, in a polyvinyl chloride film, (II)

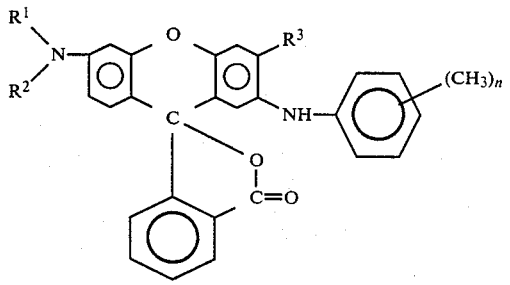

wherein $R^1$ and $R^2$ each represent an alkyl group having 1 to 6 carbon atoms of a cyclohexyl group; $R^3$ represents an alkyl group having 1 to 2 carbon atoms; and n is an integer of 0 or 1.

DETAILED DESCRIPTION OF THE PREFERRED EMBODIMENTS

The phenolic compounds of the previously described formula (I) employed as the color developers can be prepared without difficulty as described later by reacting monothiohydroquinone with its counter part dihalogenoalkanes, dihalogenoketones or dihalogenoalkyl ethers in the presence of an alkali, with high yield and high purity and at a comparatively low cost.

In the thermosensitive recording material according to the present invention, a leuco dye and the color developer can be supported on the same support material or they can be supported separately on two different support materials. In the case where a leuco dye and the color developer are supported on the same support material, a thermosensitive coloring layer comprising the leuco dye and the color developer is formed on the support material, with addition of a binder agent thereto, or a thermosensitive coloring layer comprising two layers, with the leuco dye contained in one layer, and the color developer contained in the other layer.

In the case where a leuco dye and the color developer are separately supported on the support materials, those support materials are superimposed on each other in such a manner that the surface of one support material which bears the leuco dye and the surface of the other support material which bears the color developer come into contact with each other when thermal printing is performed. Thereafter, the two support materials are separated, whereby color images are obtained in one support material. In other words, the present invention can be applied to any conventional thermosensitive recording materials which utilize the coloring reaction between a leuco dye and a color developer.

The thermosensitive recording according to the present invention can also be used as a thermal-image-transfer-type thermosensitive recording material which comprises an image transfer sheet consisting of a support material and an image transfer layer formed on the support material, containing a leuco dye, and an image acceptor sheet consisting of a support material and an image acceptor layer formed on the support material, containing the color developer.

In the case of the thermal-image-transfer-type recording material, the image transfer sheet is superimposed on the image acceptor sheet in such a manner that the image acceptor layer comes into contact with the image transfer layer of the image transfer sheet, so that thermal printing is performed on the front side or back side of the superimposed sheets, whereby the desired developed images are formed on the image acceptor layer of the acceptor sheet.

The thermosensitive recording material according to the present invention can be prepared, for example, by application of a thermosensitive coloring layer formation liquid containing the above described components to a support material, for example, paper, synthetic paper or a plastic film, and by drying the same. When the leuco dye and the color developer are supported on two separate support materials, a leuco dye dispersion or solution and a color developer dispersion or solution are applied to each support material.

As colorless or light-colored dyes for use in the present invention, a variety of conventional dyes can be employed.

The following are examples of such colorless or light-colored dyes for use in the present invention.

Crystal Violet Lactone,
3-diethylamino-6-methyl-7-anilinofluoran,
3-(N-ethyl-p-toluidino)-6-methyl-7-anilinofluoran,
3-diethylamino-6-methyl-7-(o-, p-dimethylanilino)fluoran,
3-pyrrolidino-6-methyl-7-anilinofluoran,
3-piperidino-6-methyl-7-anilinofluoran,
3-(N-cyclohexyl-N-methylamino)-6-methyl-7-anilinofluoran,
3-diethylamino-7-(o-chloroanilino)fluoran,
3-diethylamino-7-(m-trifluoromethylanilino)fluoran,
3-diethylamino-6-methyl-7-chlorofluoran,
3-diethylamino-6-methylfluoran, and
3-cyclohexylamino-6-chlorofluoran.

As a matter of course, the dyes for use in the present invention are not limited to the above examples.

It is preferable that the phenolic materials of the formula (I) for use in the present invention be employed in an amount of 1 to 6 times the amount of the leuco dye.

Specific examples of the phenolic materials of the formula (I) in which R is an alkylene group having 1 to 10 carbon atoms are as follows:

| Compound No. | |
|---|---|
| No. 1-1 | 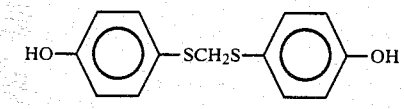 |
| No. 1-2 | 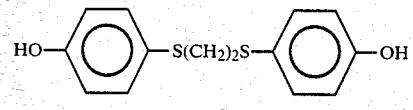 |
| No. 1-3 | 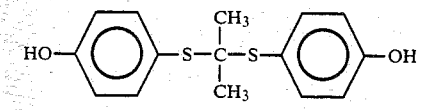 |
| No. 1-4 | 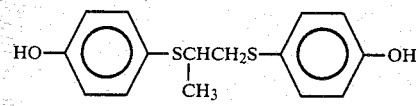 |
| No. 1-5 | 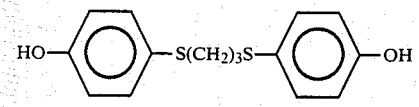 |
| No. 1-6 | 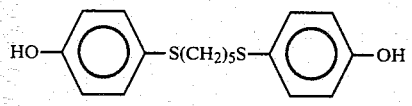 |
| No. 1-7 | 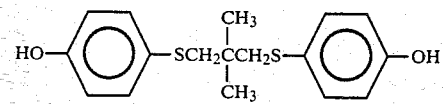 |
| No. 1-8 | 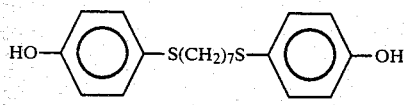 |

-continued

| Compound No. | |
|---|---|
| No. 1-9 | 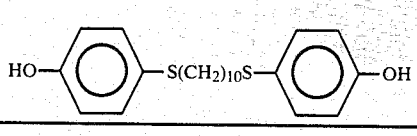 |

Specific examples of the phenolic material of the formula (I) in which R is an alkylene group having 1 to 8 carbon atoms, with 1 to 3 carbonyl groups contained in the alkylene group, but not directly bonded to S, are as follows:

| Compound No. | |
|---|---|
| No. 2-1 | 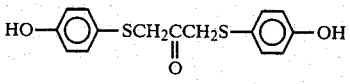 |
| No. 2-2 | 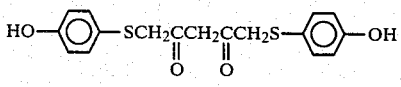 |
| No. 2-3 | 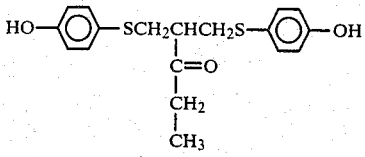 |
| No. 2-4 | 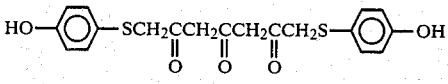 |
| No. 2-5 | 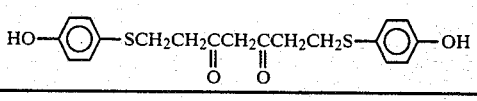 |

Specific examples of the phenolic compounds of the formula (I) in which R is an alkylene group having 2 to 15 carbon atoms, with 1 to 5 ether bonds contained in the alkylene group, are as follows:

| Compound No. | |
|---|---|
| No. 3-1 | 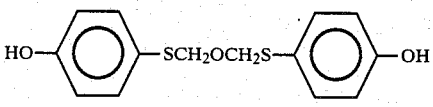 |
| No. 3-2 | 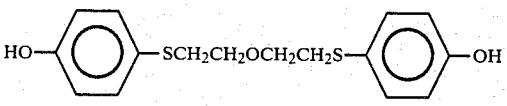 |
| No. 3-3 | 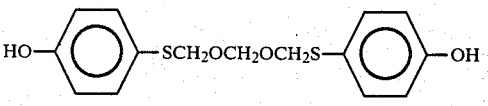 |

-continued

| Compound No. | |
|---|---|
| No. 3-4 | 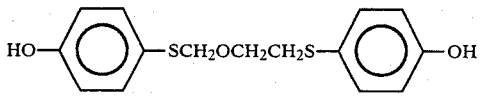 |
| No. 3-5 | 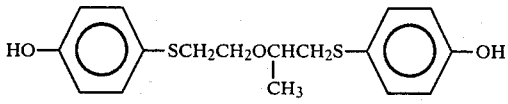 |
| No. 3-6 | 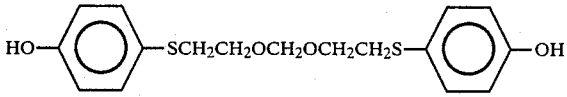 |
| No. 3-7 | 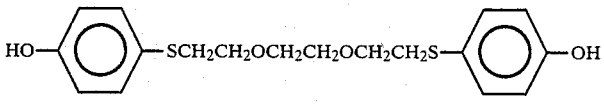 |
| No. 3-8 | 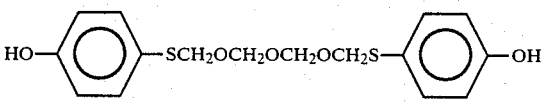 |
| No. 3-9 | 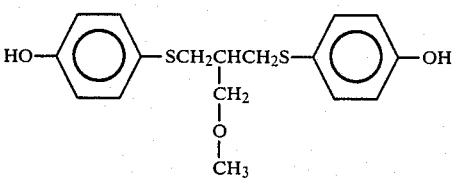 |

In the above phenolic compounds, the ether bonds can be contained in the main chain of the alkylene group or can be bonded to the side chain of the alkylene group. As indicated above, the number of carbon atoms contained in the alkylene group is usually 2 to 15 for use in the present invention. It is more preferable that the number of carbon atoms in the alkylene group be 2 to 7 and the alkylene group have 1 to 3 ether bonds.

As mentioned previously, the phenolic compounds of the general formula (I) can be prepared without difficulty. For example, the compound No. 3-2 and the compound No. 3-6 were respectively prepared as follows:

(1) Preparation of Compound No. 3-2 of the formula of

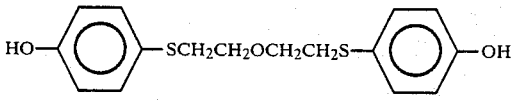

6.4 g of sodium hydroxide was dissolved in 22 g of methanol. To this solution, 20.2 g of p-hydroxybenzenethiol was added. Further, 10.4 g of bis(2-chloroethyl)ether was added dropwise to this mixture at room temperature.

After addition of the bis(2-chloroethyl)ether, the reaction mixture was cooled and freed of methanol under reduced pressure. To the residue was added 300 ml of water. Crystals were separated, which were filtered off, sufficiently washed with water and dried.

The thus obtained crystals were recrystallized from a mixed solvent of toluene and ethyl acetate, so that 15.5 g of 1,5-di(4-hydroxyphenylthio)-3-oxapentane was obtained in the form of white crystals (m.p. 93°–94° C.).

The results of elemental analysis of the product, 1,5-di(4-hydroxyphenylthio)-3-oxapentane, were as follows:

| | % C | % H | % S |
|---|---|---|---|
| Found | 59.81 | 5.78 | 19.77 |
| Calculated | 59.60 | 5.63 | 19.89 |

(2) Preparation of Compound No. 3-6 of the formula

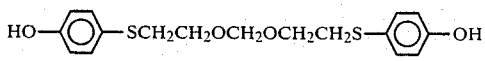

6.4 g of sodium hydroxide was dissolved in 22 g of methanol. To this solution, 20.2 g of p-hydroxybenzenethiol was added. Further, 12.6 g of bis(2-chloroethoxy)methane was added dropwise to this mixture at room temperature.

After addition of the bis(2-chloroethoxy)methane, the reaction mixture was refluxed at a methanol-refluxing temperature for 2 hours. The reaction mixture was then cooled and freed of methanol under reduced pressure.

To the residue was added 500 ml of water. Crystals separated, which were filtered off, sufficiently washed with water and dried.

The thus obtained crystals were recrystallized from a mixed solvent of toluene and ethyl acetate, so that 17.2 g of 1,7-di(4-hydroxyphenylthio)-3,5-dioxaheptane was obtained in the form of white crystals (m.p. 108°–109° C.).

The results of elemental analysis of the product, 1,7-di(4-hydroxyphenylthio)-3,5-dioxyheptane were as follows:

| | % C | % H | % S |
|---|---|---|---|
| Found | 58.08 | 5.75 | 18.14 |
| Calculated | 57.93 | 5.72 | 18.19 |

When the phenolic materials of the formula (I) in which R is an alkylene group having 2 to 15 carbon atoms, with 1 to 5 ether bonds contained in the alkylene group, are employed in combination with the particular fluoran compounds of the following formula, the developed images are particularly stable against plasticizers and do not discolor when they are brought into contact with a film containing a plasticizer, for instance, a polyvinyl chloride film.

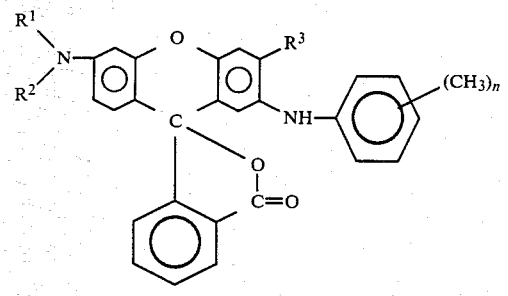

wherein $R^1$ and $R^2$ each represent an alkyl group having 1 to 6 carbon atoms or a cyclohexyl group; $R^3$ represents an alkyl group having 1 to 2 carbon atoms; and n is an integer of 0 or 1.

Specific examples of the fluoran compounds of the above formula are as follows:

3-diethylamino-6-methyl-7-anilinofluoran,
3-(N-ethyl-N-isoamylamino)-6-methyl-7-anilinofluoran,
3-(N-methyl-N-n-hexylamino)-6-methyl-7-anilinofluoran, and
3-(N-cyclohexyl-N-methylamino)-6-methyl-7-anilinofluoran.

The above fluoran compounds can be used alone or in combination.

In the thermosensitive coloring layer of a thermosensitive recording material according to the present invention, the following binder agents can be employed: Water-soluble organic polymers such as polyvinyl alcohol, methoxy cellulose, hydroxyethyl cellulose, carboxymethyl cellulose, polyvinyl pyrrolidone, polyacrylamide, polyacrylic acid, starch and gelatin; and water emulsions of polystyrene, copolymer of vinyl chloride and vinyl acetate, and polybutyl methacrylate.

Furthermore, in the thermosensitive coloring layer, the following additives can be contained in the form of fine powder to obtain clear images and to prevent formation of dusts which may accumulate on a thermal head when a thermal printer with a thermal head is employed for recording: Calcium carbonate, silica, alumina, magnesia, talc, titania, barium sulfate and aluminum stearate.

Embodiments of the thermosensitive recording material according to the present invention will now be explained by referring to the following examples.

EXAMPLE 1

A dispersion A-1, a dispersion B-1 and a dispersion C-1 were separately prepared by grinding and dispersing the following respective components in a ceramic bowl for 2 days:

| | Parts by Weight |
|---|---|
| Dispersion A-1 | |
| 3-(N—cyclohexyl-N—methylamino)-6-methyl-7-anilinofluoran | 20 |
| 10% aqueous solution of hydroxyethyl cellulose | 20 |
| Water | 60 |
| Dispersion B-1 | |
| 1,3-di(4-hydroxyphenylthio)propane (Compound No. 1-5, m.p. 81–83° C.) | 20 |
| 10% aqueous solution of hydroxyethyl cellulose | 20 |
| Water | 60 |
| Dispersion C-1 | |
| Calcium carbonate | 20 |
| 5% aqueous solution of methyl cellulose | 20 |
| Water | 60 |

10 parts by weight of the dispersion A-1, 30 parts by weight of the dispersion B-1, 30 parts by weight of the dispersion C-1 and 10 parts by weight of a 20% aqueous solution of polyvinyl alcohol were mixed to prepare a thermosensitive coloring layer formation liquid. This thermosensitive coloring layer formation liquid was applied to the surface of a sheet of commercially available high quality paper (50 g/m$^2$) by a wire bar and was then dried, whereby a thermosensitive coloring layer was formed thereon. The deposition of the thermosensitive coloring layer on the sheet was in the range of 4 to 5 g/m$^2$ when dried. The thus prepared thermosensitive recording material was subjected to calendering, so that surface of the thermosensitive coloring layer was made smooth to the degree ranging from 500 to 600 sec in terms of Bekk's smoothness, whereby a thermosensitive recording material No. 1 according to the present invention was prepared.

EXAMPLE 2

Example 1 was repeated except that the dispersion B-1 employed in Example 1 was replaced by a dispersion B-2 with the following formulation, whereby a thermosensitive recording material No. 2 according to the present invention was prepared.

| Dispersion B-2 | Parts by Weight |
|---|---|
| 1,5-di(4-hydroxyphenylthio)pentane (Compound No. 1-6, m.p. 98–99° C.) | 20 |
| 10% aqueous solution of hydroxyethyl cellulose | 20 |
| Water | 60 |

EXAMPLE 3

Example 1 was repeated except that the dispersion B-1 employed in Example 1 was replaced by a dispersion B-3 with the following formulation, whereby a thermosensitive recording material No. 3 according to the present invention was prepared.

| Dispersion B-3 | Parts by Weight |
|---|---|
| 1,3-di(4-hydroxyphenylthio)acetone (Compound No. 2-1, m.p. 74–75° C.) | 20 |
| 10% aqueous solution of hydroxyethyl cellulose | 20 |
| Water | 60 |

EXAMPLE 4

Example 1 was repeated except that the dispersion B-1 employed in Example 1 was replaced by a dispersion B-4 with the following formulation, whereby a thermosensitive recording material No. 4 according to the present invention was prepared.

| Dispersion B-4 | Parts by Weight |
|---|---|
| 1,7-di(4-hydroxyphenylthio)-hepta-3,5-dione (Compound No. 2-5) | 20 |
| 10% aqueous solution of hydroxyethyl cellulose | 20 |
| Water | 60 |

COMPARATIVE EXAMPLE 1

Example 1 was repeated except that the dispersion B-1 employed in Example 1 was replaced by a dispersion CB-1 with the following formulation, whereby a comparative thermosensitive recording material No. 1 was prepared.

| Dispersion CB-1 | Parts by Weight |
|---|---|
| Bisphenol A | 20 |
| 10% aqueous solution of hydroxyethyl cellulose | 20 |
| Water | 60 |

COMPARATIVE EXAMPLE 2

Example 1 was repeated except that the dispersion B-1 employed in Example 1 was replaced by a dispersion CB-2 with the following formulation, whereby a comparative thermosensitive recording material No. 2 was prepared.

| Dispersion CB-2 | Parts by Weight |
|---|---|
| Benzyl p-hydroxybenzoate | 20 |
| 10% aqueous solution of hydroxyethyl cellulose | 20 |
| Water | 60 |

The thus prepared thermosensitive recording materials No. 1 through 4 according to the present invention and the comparative thermosensitive recording materials No. 1 and No. 2 were subjected to thermal printing by a G-III facsimile apparatus (made by Ricoh Company, Ltd.) at a printing speed of 0.94 m/sec, with the voltage applied thereto changed to 3 steps of 16 V, 18 V and 20 V. The density of the developed images were measured by Macbeth densitometer RD-514. The results are shown in Table 1.

TABLE 1

| | Thermosensitive Recording Material | Developed Image Density (0.94 m/sec) | | | Background Density |
|---|---|---|---|---|---|
| | | 16 V | 18 V | 20 V | |
| Example 1 | No. 1 | 1.30 | 1.33 | 1.33 | 0.14 |
| Example 2 | No. 2 | 1.09 | 1.31 | 1.34 | 0.10 |
| Example 3 | No. 3 | 1.24 | 1.27 | 1.28 | 0.10 |
| Example 4 | No. 4 | 1.23 | 1.25 | 1.26 | 0.09 |
| Comparative Example 1 | No. 1 | 0.31 | 0.43 | 0.86 | 0.10 |
| Comparative Example 2 | No. 2 | 0.56 | 1.04 | 1.26 | 0.09 |

The thermosensitive recording materials with images printed under the conditions of the printing speed being 0.94 m/sec and the applied voltage being 20 V were allowed to stand at room temperature for one week and the image densities were measured again by the Macbeth densitometer RD-514 and they were visually checked whether or not crystals of the phenolic material were separated on the surface of the recording materials. The results are shown in Table 2.

TABLE 2

| | Thermosensitive Recording Material | Image Density after 1 week | Separation of Phenolic Material |
|---|---|---|---|
| Example 1 | No. 1 | 1.33 | None |
| Example 2 | No. 2 | 1.33 | None |
| Example 3 | No. 3 | 1.27 | None |
| Example 4 | No. 4 | 1.25 | None |
| Comparative Example 1 | No. 1 | 0.84 | None |
| Comparative Example 2 | No. 2 | 0.97 | Observed |

As can be seen from the results shown in Table 1 and Table 2, the thermosensitive recording materials according to the present invention are excellent in development performance in high-speed recording and provided stabler images as compared with the comparative thermosensitive recording material examples.

EXAMPLE 5

A dispersion A-1, a dispersion B-5 and a dispersion C-1 were separately prepared by grinding and dispersing the following respective components in a ceramic bowl for 2 days:

| | Parts by Weight |
|---|---|
| Dispersion A-1 (the same as that employed in Example 1) | |
| 3-(N—cyclohexyl-N—methylamino)-6-methyl-7-anilinofluoran | 20 |
| 10% aqueous solution of hydroxyethyl cellulose | 20 |
| Water | 60 |
| Dispersion B-5 | |
| 1,5-di(4-hydroxyphenylthio)-3-oxa-pentane (Compound No. 3-2, m.p. 93–94° C.) | 20 |
| 10% aqueous solution of hydroxyethyl cellulose | 20 |
| Water | 60 |
| Dispersion C-1 (the same as that employed in Example 1) | |
| Calcium carbonate | 20 |
| 5% aqueous solution of methyl cellulose | 20 |
| Water | 60 |

10 parts by weight of the dispersion A-1, 30 parts by weight of the dispersion B-5, 30 parts by weight of the dispersion C-1 and 10 parts by weight of a 20% alkali aqueous solution of an isobutylene-maleic anhydride copolymer were mixed to prepare a thermosensitive coloring layer formation liquid.

This thermosensitive coloring layer formation liquid was applied to the surface of a sheet of commercially available high quality paper (50 g/m$^2$) by a wire bar and was then dried, whereby a thermosensitive layer was formed thereon. The deposition of the thermosensitive layer on the sheet was in the range of 4 to 5 g/m$^2$ when dried. The thus prepared thermosensitive recording material was subjected to calendering, so that surface of the thermosensitive layer was made smooth to the degree ranging from 500 to 600 sec in terms of Bekk's smoothness, whereby a thermosensitive recording material No. 5 according to the present invention was prepared.

EXAMPLE 6

Example 5 was repeated except that the dispersion B-5 employed in Example 5 was replaced by a dispersion B-6 with the following formulation, whereby a thermosensitive recording material No. 6 according to the present invention was prepared.

| Dispersion B-6 | Parts by Weight |
|---|---|
| 1,8-di(4-hydroxyphenylthio)-3,6-dioxaoctane (Compound No. 3-6, m.p. 100–101° C.) | 20 |
| 10% aqueous solution of hydroxyethyl cellulose | 20 |
| Water | 60 |

The thus prepared thermosensitive recording materials No. 5 and 6 according to the present invention were subjected to thermal printing by a G-III facsimile apparatus (made by Ricoh Company, Ltd.) at a printing speed of 0.94 m/sec, with the voltage applied thereto changed to 3 steps of 16 V, 18 V and 20 V. The density of each developed image was measured by Macbeth densitometer RD-514. The results are shown in Table 3.

TABLE 3

| | Thermosensitive Recording Material | Developed Image Density (0.94 m/sec) | | | Background Density |
|---|---|---|---|---|---|
| | | 16 V | 18 V | 20 V | |
| Example 5 | No. 5 | 1.18 | 1.30 | 1.31 | 0.11 |
| Example 6 | No. 6 | 0.71 | 1.19 | 1.27 | 0.08 |
| Comparative Example 1 | No. 1 | 0.31 | 0.43 | 0.86 | 0.10 |
| Comparative Example 2 | No. 2 | 0.56 | 1.04 | 1.26 | 0.09 |

The thermosensitive recording materials with images printed under the conditions of the printing speed being 0.94 m/sec and the applied voltage being 20 V were allowed to stand at room temperature for one week and the image densities were measured again by the Macbeth densitometer RD-514 and they were visually checked whether or not crystals of the phenolic material were separated on the surface of the recording materials. The results are shown in Table 4.

TABLE 4

| | Thermosensitive Recording Material | Image Density after 1 week | Separation of Phenolic Material |
|---|---|---|---|
| Example 5 | No. 5 | 1.30 | None |
| Example 6 | No. 6 | 1.20 | None |
| Comparative Example 1 | No. 1 | 0.84 | None |
| Comparative Example 2 | No. 2 | 0.97 | Observed |

As can be seen from the results shown in Table 3 and Table 4, the thermosensitive recording materials according to the present invention are excellent in development performance in high-speed recording and provided stabler images as compared with the comparative thermosensitive recording materials.

EXAMPLE 7

Example 5 was repeated except that the dispersion A-1 employed in Example 5 was replaced by a dispersion A-2 with the following formulation, whereby a thermosensitive recording material No. 7 according to the present invention was prepared.

| Dispersion A-2 | Parts by Weight |
|---|---|
| 3-(N—ethyl-N—isoamylamino)-6-methyl-7-anilinofluoran | 20 |
| 10% aqueous solution of hydroxyethyl cellulose | 20 |
| Water | 60 |

EXAMPLE 8

Example 5 was repeated except that the dispersion A-1 employed in Example 5 was replaced by a dispersion A-3 with the following formulation, whereby a thermosensitive recording material No. 8 according to the present invention was prepared.

| Dispersion A-3 | Parts by Weight |
|---|---|
| 3-diethylamino-6-methyl-7-anilinofluoran | 20 |
| 10% aqueous solution of hydroxyethyl cellulose | 20 |
| Water | 60 |

EXAMPLE 9

Example 5 was repeated except that the dispersion A-1 employed in Example 5 was replaced by a dispersion A-4 with the following formulation, whereby a thermosensitive recording material No. 9 according to the present invention was prepared.

| Dispersion A-4 | Parts by Weight |
|---|---|
| 3-di-n-butylamino-7-(o-chloroanilino) fluoran | 20 |
| 10% aqueous solution of hydroxyethyl cellulose | 20 |
| Water | 60 |

EXAMPLE 10

Example 5 was repeated except that the dispersion A-1 employed in Example 5 was replaced by a dispersion A-5 with the following formulation, whereby a thermosensitive recording material No. 10 according to the present invention was prepared.

| Dispersion A-5 | Parts by Weight |
|---|---|
| 3-(N—ethyl-N—p-toluidino)-6-methyl-7-anilinofluoran | 20 |
| 10% aqueous solution of hydroxyethyl cellulose | 20 |
| Water | 60 |

The thus prepared thermosensitive recording materials No. 7 through 10 according to the present invention were subjected to thermal printing by the G-III facsimile apparatus and to the preservability tests in the same manner as in Example 5. The results were as good as in Example 5.

Further, the thermosensitive recording materials No. 5 and No. 7 through No. 10 were subjected to thermal printing by a gradient test apparatus (made by Toyo Seiki Co., Ltd.) at 150° C. with a pressure of 2 kg/cm$^2$ applied to each thermosensitive recording material for 1 second. From each thermosensitive recording material, a portion of 4 cm$^2$ including a printed area was cut off and was then covered with a polyvinyl chloride wrapping film (Trade Name: Polyma-wrap V-300 made by Shin-Etsu Polymer Company, Ltd.), with a pressure of 500 g/cm$^2$ applied thereto for 5 hours.

Changes in image density of the printed images in each thermosensitive recording material were measured by a Macbeth densitometer RD-514.

The results of that measurement are shown in Table 5.

TABLE 5

| | Thermosensitive Recording Material | Wrapping Film Contact Test | | Background Density |
|---|---|---|---|---|
| | | Initial Image Density | Image Density after 5 hours | |
| Example 5 | No. 5 | 1.35 | 1.08 | 0.11 |
| Example 7 | No. 7 | 1.32 | 0.91 | 0.12 |
| Example 8 | No. 8 | 1.35 | 1.02 | 0.11 |
| Example 9 | No. 9 | 1.28 | 0.11 | 0.08 |
| Example 10 | No. 10 | 1.36 | 0.09 | 0.08 |

As can be seen from the results shown in Table 5, the printed image areas of the thermosensitive recording materials No. 5, No. 7 and No. 8 according to the present invention were more resistant to discoloration which may be caused by contact with the polyvinyl chloride wrapping film, as compared with the thermosensitive recording materials No. 9 and No. 10.

The above results indicates that when the phenolic materials of the formula (I) in which R is an alkylene group having 2 to 15 carbon atoms, with 1 to 5 ether bonds contained in the alkylene group, were employed in combination with the particular fluoran compounds of the previously described formula (II), the developed images were stabler against the polyvinyl chloride film and discolored significantly less when they were brought into contact with the film, as compared with the thermosensitive recording materials in which the above phenolic materials and fluoran compounds other than the above particular fluoran compounds were employed in combination.

In any case, according to the present invention, by use of any of the phenolic materials for use in the present invention, a thermosensitive recording material with the following advantages over the conventional thermosensitive recording materials can be obtained:

(1) High thermal sensitivity (i.e. high thermal response) is obtained, without using any sensitizers or melting-point reducing agent. Due to the high thermal response, images can be recorded with high density and clearness in high speed recording, even if image information to be recorded is dense per unit area.

(2) Printed images do not substantially discolor with time. In other words, the quality of printed images is extremely stable, and no components contained in the thermosensitive recording material separate out in the form of crystals on the surface thereof during storage.

(3) No components come out from the thermosensitive recording material and accumulate on or adhere to a thermal head during thermal printing by use of a thermal printer with a thermal head.

(4) By applying a thermosensitive coloring layer formation liquid prepared in accordance with the present invention to a sheet of thin base paper or to a film, an excellent thermosensitive copy sheet for use with an infrared lamp or a strobo flash can be prepared.

(5) Since the coating amount of the thermosensitive coloring layer formation liquid can be reduced, in comparison with the conventional thermosensitive recording materials, the manufacturing efficiency of the thermosensitive recording materials according to the present invention can be significantly increased as compared with the manufacturing efficiency of the conventional thermosensitive recording materials.

(6) The phenolic materials employed in the present invention as the color developer can be synthesized with higher yield and higher purity and at a comparatively lower cost, as compared with the conventional color developers.

The thermosensitive recording materials according to the present invention can be employed in a variety of fields, for example, as thermosensitive-recording-type label sheets or as thermosensitive-recording-type magnetic tickets, by utilizing the characteristic image stability.

In the case of a thermosensitive recording label sheet, a thermosensitive recording layer comprising any of the above described fluoran compounds and the phenolic materials is formed on one side of a support material, and to the other side of the support material, a disposable sheet is attached through an adhesive layer.

In the case of a thermosensitive-recording-type magnetic ticket, the disposable sheet in the label sheet is replaced by a magnetic recording layer comprising as the main components a ferromagnetic material and a binder agent.

What is claimed is:

1. In a thermosensitive recording material comprising a colorless or light-colored coloring material, a color developer capable of inducing color formation in said colorless or light-colored coloring material upon application of heat thereto, support means for supporting said coloring material and said color developer so that said color formation can be induced, the improvement wherein said color developer is a phenolic material of the formula

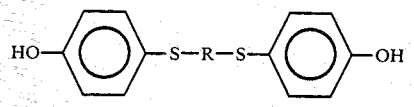

wherein R is selected from the group consisting of an alkylene group having 1 to 10 carbon atoms; an alkylene group having 1 to 8 carbon atoms and containing 1 to 3 carbonyl groups which are not directly bonded to S in the formula; and an alkylene group having 2 to 15 carbon atoms and containing 1 to 5 ether bonds.

2. A thermosensitive recording material as claimed in claim 1, wherein R is an alkylene group having 2 to 15 carbon atoms, and containing 1 to 5 ether bonds; and said colorless or light-colored coloring material is a fluoran compound of the formula

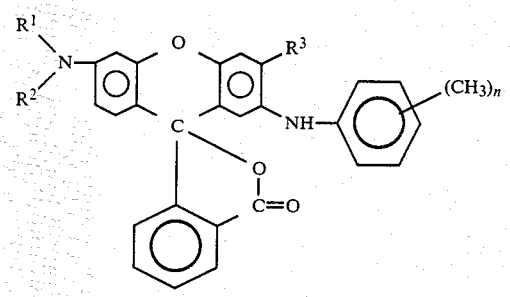

wherein $R^1$ and $R^2$ each represent an alkyl group having 1 to 6 carbon atoms or a cyclohexyl group; $R^3$ represents an alkyl group having 1 to 2 carbon atoms; and n is an integer of 0 to 1.

3. A thermosensitive recording material as claimed in claim 1, wherein the amount of said color developer is 1 to 6 times the amount of said colorless or light-colored coloring material.

4. In a thermosensitive recording material comprising a support, a thermosensitive recording layer on said support, said thermosensitive recording layer containing a binder, a colorless or light-colored coloring material and a color developer capable of inducing color formation in said colorless or light-colored coloring material upon application of heat thereto, the improvement wherein said color developer is a phenolic material of the formula

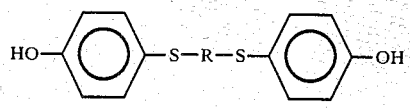

wherein R is selected from the group consisting of an alkylene group having 1 to 10 carbon atoms; an alkylene group having 1 to 8 carbon atoms and containing 1 to 3 carbonyl groups which are not directly bonded to S in the formula; and an alkylene group having 2 to 15 carbon atoms and containing 1 to 5 ether bonds.

5. A thermosensitive recording material as claimed in claim 4 in which said thermosensitive recording layer is comprised of a first sub-layer containing said colorless or light-colored coloring material and a second sub-layer containing said color developer, one of said sub-layers being overlaid on the other of said sub-layers.

6. In a thermosensitive recording material comprising a first support having a first layer coated thereon, said first layer containing a first binder and a colorless or light-colored coloring material, a second support having a second layer coated thereon, said second layer containing a second binder and a color developer capable of inducing color formation in said colorless or light-colored coloring material upon application of heat thereto, the improvement wherein said color developer is a phenolic material of the formula

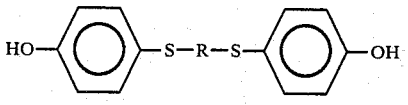

wherein R is selected from the group consisting of an alkylene group having 1 to 10 carbon atoms; an alkylene group having 1 to 8 carbon atoms and containing 1 to 3 carbonyl groups which are not directly bonded to S in the formula; and an alkylene group having 2 to 15 carbon atoms and containing 1 to 5 ether bonds.

* * * * *